United States Patent [19]

Saur

[11] 4,306,210

[45] Dec. 15, 1981

[54] TWO-STAGE TEMPERATURE SWITCH

[75] Inventor: Roland Saur, Stuttgart, Fed. Rep. of Germany

[73] Assignee: Behr-Thomson Dehnstoffregler GmbH, Kornwestheim, Fed. Rep. of Germany

[21] Appl. No.: 370

[22] Filed: Dec. 29, 1978

[30] Foreign Application Priority Data

Dec. 31, 1977 [DE] Fed. Rep. of Germany ..... 2759251

[51] Int. Cl.[3] ..... H01H 37/00; H01H 61/00

[52] U.S. Cl. ..... 337/2; 337/107

[58] Field of Search ..... 337/1, 2, 3, 107; 307/117; 340/593, 594, 598, 595; 236/101 C; 123/41.15, 41.12

[56] References Cited

U.S. PATENT DOCUMENTS

| | | | |
|---|---|---|---|
| 2,321,852 | 6/1943 | Ray | 337/353 |
| 2,759,066 | 8/1956 | Short et al. | 340/593 |
| 3,386,067 | 5/1968 | Costanzo | 338/100 |
| 3,840,834 | 10/1974 | Obenhaus et al. | 337/107 |
| 4,038,627 | 7/1977 | Johnson | 337/107 |
| 4,044,348 | 8/1977 | Huebscher | 307/117 |

FOREIGN PATENT DOCUMENTS

| | | |
|---|---|---|
| 977187 | 5/1965 | Fed. Rep. of Germany . |
| 1798294 | 2/1972 | Fed. Rep. of Germany . |
| 1590149 | 2/1975 | Fed. Rep. of Germany . |
| 2451327 | 5/1975 | Fed. Rep. of Germany . |
| 2444931 | 4/1976 | Fed. Rep. of Germany . |

*Primary Examiner*—Harold Broome

*Attorney, Agent, or Firm*—Browdy and Neimark

[57] ABSTRACT

An electrical switch assembly including two separate, temperature-dependent electrical switches, one of the electrical switches being substantially mechanically acting and the second of the electrical switches being a non-mechanical, solid-state switch. The mechanical switch may be a bimetallic switch of various configurations or may consist of a snap or toggle switch actuated by the expansion of a suitable fluid, for example a wax mixture. The solid-state switch element may be a resistive element which inhibits the electrical conduction upon the occurrence of elevated or lowered temperature, depending on the type of material used. Various embodiments of the mechanical portion of the switch assembly are presented.

14 Claims, 4 Drawing Figures

TWO-STAGE TEMPERATURE SWITCH

FIELD OF THE INVENTION

The invention relates to an electrical switch responsive to temperature. More particularly, the invention relates to a temperature-sensitive switch containing two electrical switching elements disposed in a common housing and equipped with an electrical plug with at least one contact pin.

BACKGROUND OF THE INVENTION

It is a common requirement for controlling machinery and apparatus to initiate electrical switching processes at two separate temperature levels. For example, in motor vehicles, a warning lamp is energized when the coolant exceeds a given temperature. When a second and higher temperature level is reached, a further electrical connection may be made or broken to initiate required actions.

OBJECTS AND SUMMARY OF THE INVENTION

It is a principal object of the present invention to provide a temperature-responsive electrical switch containing at least two separate electrical circuits which may be independently switched on and off in dependence of the occurrence of different levels of temperature.

This object is attained according to the present invention by providing a single housing in which there is disposed firstly a temperature-dependent mechanical electrical switch and, at least secondly, a temperature-dependent semiconductor element, there being separate electrical contact pins leading to each of the electrical switches.

It is an advantageous feature of the invention to employ semiconductor elements whose resistivity is a function of temperature. These per se known semiconductor resistors may have a negative temperature coefficient (NTC-resistors), also sometimes called hot conductors, or they may have a positive temperature coefficient (PTC-resistors), also sometimes called cold conductors.

The two-stage temperature switch according to the present invention provides substantial advantages with respect to adjustment, assembly of the individual parts, as well as the maintenance of design tolerances.

In a favorable feature of the invention, the temperature-dependent semiconductor element is disposed within the unitary housing of the switch assembly.

Advantageously, the temperature-dependent semiconductor element may be disposed between the housing and an insulating electrical plug constituting an extension of the housing.

Suitably, the temperature-dependent semiconductor element may be embodied as a flat ring which makes electrical contact with one of the contact pins in the plug by means of an elastic contact plate having flexible fingers that press on an axial surface of the semiconductor element.

However, in another advantageous embodiment of the invention, the temperature-dependent semiconductor element may be in the shape of a disc or even a plurality of discs disposed within or on the housing.

In this case too, the electrical contact between the disc-shaped semiconductor element and one of the electrical contact pins in the plug may be made via an elastic contact ring provided with flexible contact fingers.

In one advantageous embodiment of the invention, the temperature-dependent mechanical switching element is a snap-action switch including an actuating arm pivoted on an extension of one of the electrical contact pins and cooperating with a spring-loaded contact post which makes and breaks the electrical continuity in the associated circuit. An advantageous feature of the invention provides that the actuating lever of the mechanical switch is moved by a diaphragm which undergoes displacement as the result of changes in volume of a temperature-dependent fluid contained in the space closed off by the diaphragm.

In a second exemplary embodiment of the invention, the mechanical switching element is a bimetallic strip disposed in a hollow space within the housing, the bimetallic strip being fastened at one end and being provided with contact means for opening and closing an associated electrical circuit upon the occurrence of a given temperature level.

In yet another embodiment of the invention, the mechanical switch may be a bimetallic snap-disc provided with a suitable electrical contact for making and breaking the electrical circuit upon the occurrence of a given temperature level. Other advantages and characteristics of the invention will become apparent from a detailed description taken in conjunction with the drawing.

THE DRAWING

DESCRIPTION OF THE PREFERRED EMBODIMENTS

Figure 1:
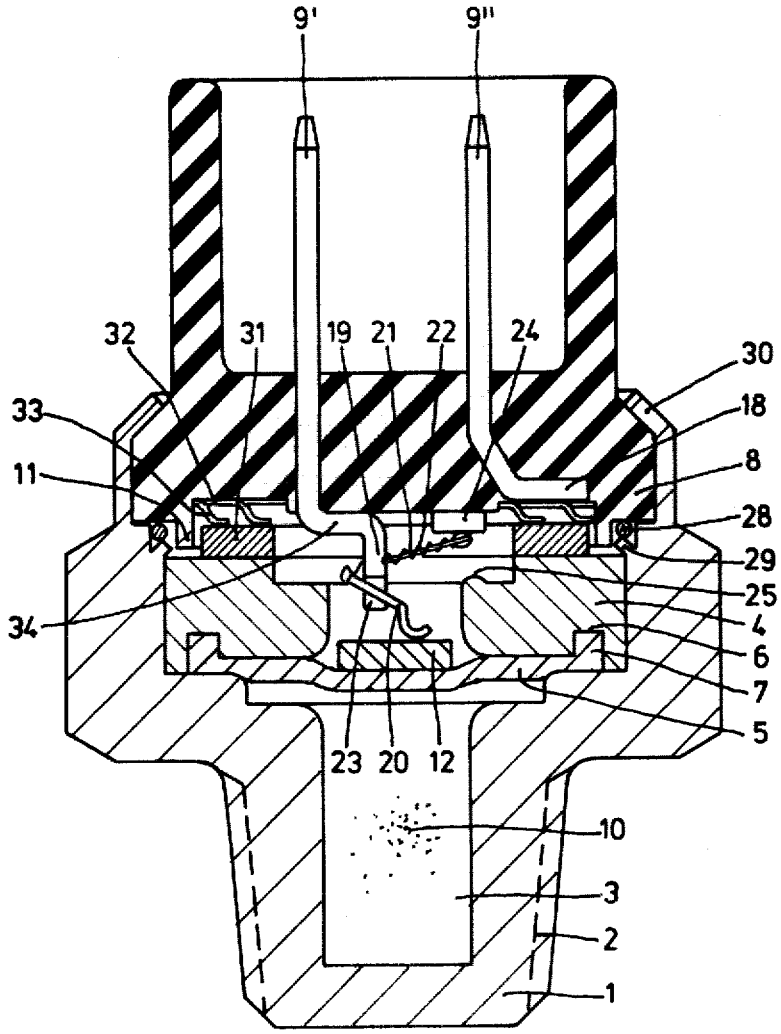
FIG. 1 is a sectional, axial view of a first embodiment of the two-stage switch according to the invention in which the mechanical switch is a snap-action switch.

The two-stage temperature-dependent switch according to the invention illustrated in FIG. 1 includes a housing 1 with external threads 2 for installation in a suitable component of an associated apparatus whose temperature is to be controlled. Defined within the housing 1 is a hollow volume 3 and mounted at one end of the housing is an insulating plug 8 which may be suitably affixed therein by means of the crimped edge 3 and sealed with respect to the outside by a suitable seal 28. In the embodiment shown, the sealing ring 28 is held in place by a sealing lip 29 which is part of the housing 1. The switch according to the invention may be threadedly engaged with, for example, a tube or a block in which a coolant circulates, for example, the coolant of an internal combustion engine, so that the switch actuation takes place on the basis of the coolant temperature.

Figure 2:
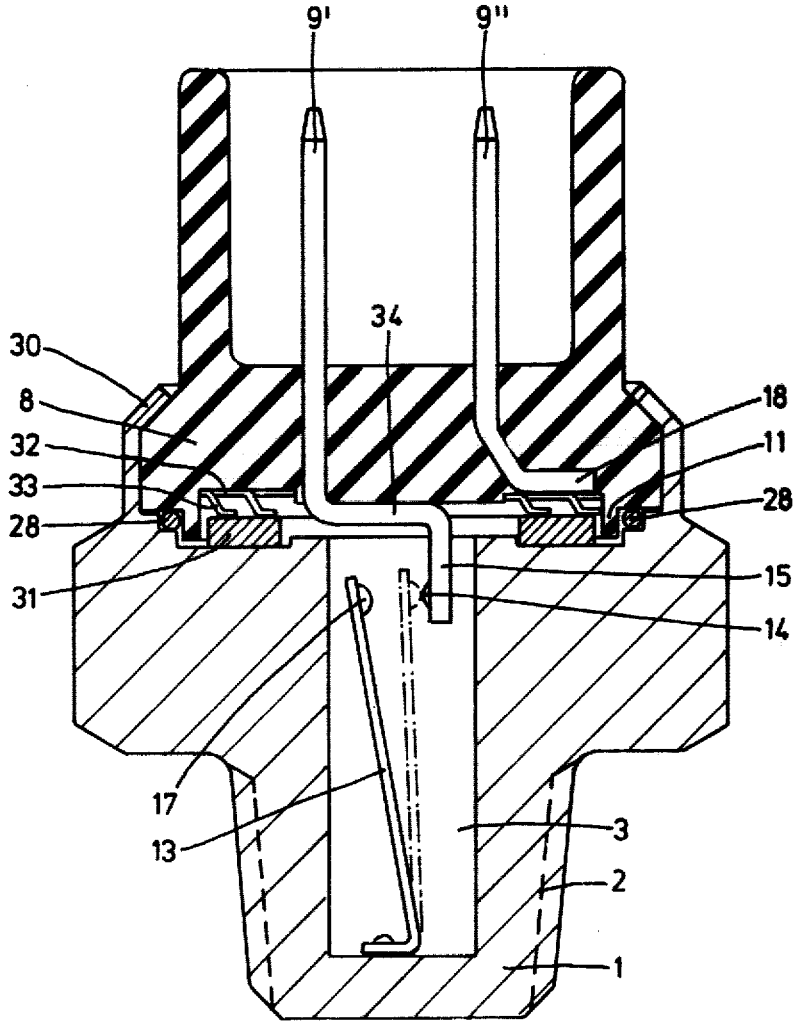
FIG. 2 is a sectional, axial illustration of a second embodiment of the invention in which the mechanical switch is a bimetallic strip.
Figure 3:
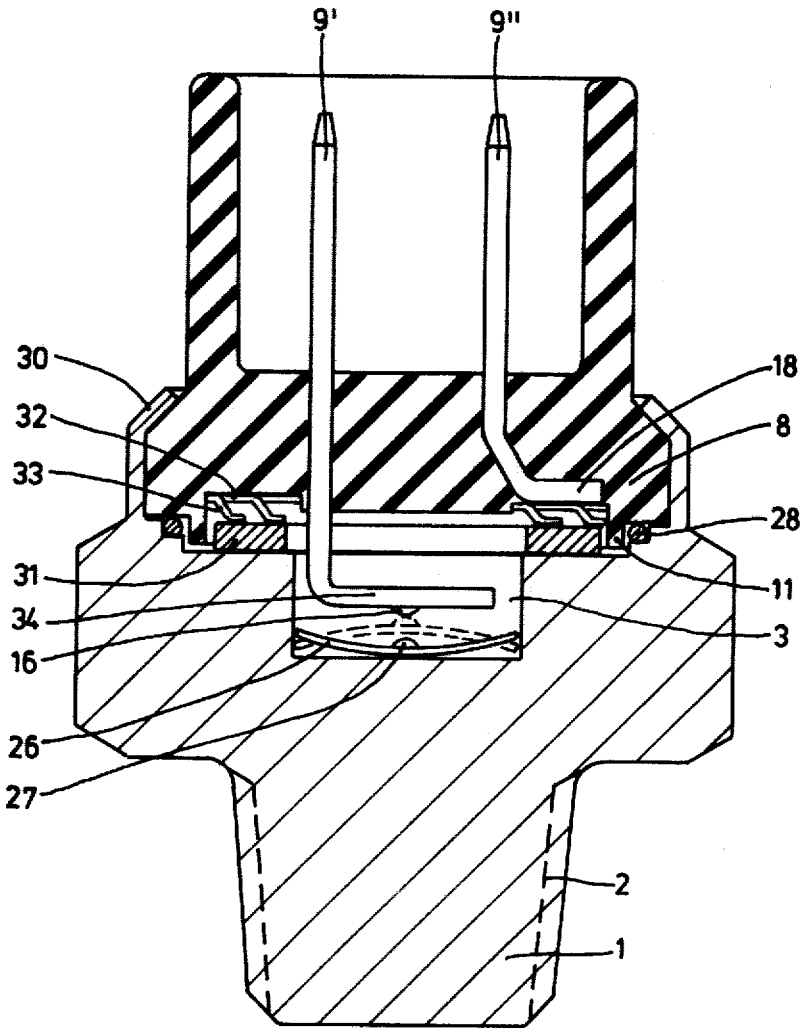
FIG. 3 is a third exemplary embodiment of the invention in which the mechanical switch is a bimetallic snap-disc.

The foregoing description is common to all three preferred embodiments illustrated in FIGS. 1, 2 and 3. In the first embodiment, illustrated in FIG. 1, the temperature dependent mechanical switching element is a snap-switch constituted by an actuating lever 20 which is pivotably carried in a downwardly angled portion 19 of one of the contact pins 9'. In the illustrated embodiment, the actuating lever 20 has a slot which cooperates with a tab 23 of the angled part 19. The actuating lever 20 is connected with a contact post 29 which is loaded by a spring 21. The contact post 29 alternates between two stable positions, one of them being an electrically opened condition in which it makes contact with a pad 24 disposed on the plug 8 and a second position in which it makes contact with an electrically conducting contact 25. In the example of FIG. 1, the contact 25 is part of a closure member 4 made of electrically conducting material and held in the housing by the annular lip 29. The closure member 4 has a preferably circular groove 6 which holds the bulging periphery 7 of a flexible diaphragm 5. The hollow space 10 is filled with a liquid, a gas or preferably a mixture of waxes whose volume changes with temperature. This per se known wax mixture changes state at a precisely defined temperature. The corresponding change in volumne causes a bulging of the diaphragm 5 which, in the illustrated example, would cause the diaphragm 5 to undergo an upward excursion as illustrated in FIG. 1 when the temperature of the wax mixture increases. The motion of the diaphragm 5 is transmitted via a plate 12 to the aforementioned actuating lever 20 of the snap-switch. When the external fluid or coolant whose temperature is to be signaled by the two-stage temperature switch increases to or exceeds a given temperature, the extensible material 10 expands and the snap-switch closes, i.e., the contact post 21 switches over to its position against the contact 25, thereby establishing electrical communication between the pin 9' and the housing 1 which may be connected, for example, to ground.

The second independent switch incorporated within the two-stage switch of the invention is embodied in FIG. 1 as a temperature-dependent semiconductor element 31, for example in the form of an annulus. Pressing against the semiconductor element 31 are elastic fingers 33 belonging to a contact ring 32 which also communicates electrically with a part of a second electrical pin 9''.

If the temperature-dependent semiconductor element 31 is a cold conductor (PTC-resistor) its resistance increases with increasing temperature until the current flow therethrough is substantially interrupted. Accordingly, the semiconductor element 31 acts as an off switch in the electrical circuit defined by the electrical pin 9'', the contact ring 32, the semiconductor element 31, the closure element 4 and the housing 1. If the temperature-dependent semiconductor element 31 is a so-called hot conductor (NTC-resistor) then an increasing temperature will cause its resistance to drop, thereby permitting a current flow, while a decrease of temperature will result in current reduction or shut-off.

Preferably, the strength of the spring 22 is sufficient so that it may serve as a return spring for the diaphragm 5 when the temperature of the material 10 decreases and its volume also decreases, in addition to serving as the snap-spring for the switching post 21. The second embodiment of the invention illustrated in FIG. 2 carries the same reference numerals for parts identical with the embodiment of FIG. 1.

In the second embodiment illustrated in FIG. 2, the temperature-dependent mechanical switch is embodied as a bimetallic switch including a bimetallic strip 13 fastened at one end in the hollow space 3, suitably at the base thereof. The free end of the bimetallic strip 13 may be provided with an electrical contact point 17 which cooperates with another electrical contact point 14 mounted on a suitably shaped leg 15 of the electrical pin 9'. When the temperature of the coolant or fluid to be controlled increases, the temperature of the housing 1 also increases, thereby causes the bimetallic strip 13 to move from the fully drawn-out position into the dash-dotted position, thereby making electrical contact with the contact 14 and causing the establishment of an electrical circuit from the pin 9' to the housing 1. The construction and function of the second semiconductor element 31 is identical to that previously described in connection with FIG. 1.

In the third exemplary embodiment of the invention, illustrated in FIG. 3, the semiconductor element 31 also functions in the same way as previously described. In this embodiment, the mechanical switch is a bimetallic snap-disc 26 dissposed in a suitably shaped space 3 of the housing 1. Disposed on the disc 26 is an electrical contact point 27 which cooperates with a similar contact point 16 located on a suitably shaped extension 34 of the electrical pin 9'. When the temperature of the surrounding coolant and thus of the housing 1 increases, the bimetallic snap-disc 26 abruptly snaps out of the fully-drawn position into the position shown in dashed lines, thereby establishing electrical contact between the pin 9' and the housing 1.

Although the invention has been described in a number of preferred exemplary embodiments, it is not limited thereto and may be embodied in any variant of some or all of the elements of the switch of the invention as well as any combination of modified elements thereof. For example, it is possible to construct the mechanical switch as a pressure-sensitive switch disposed on the closure member 4 (FIG. 1) on which the expanding fluid 10 exerts a pressure via the diaphragm 5 and the disc 12.

Similarly, the contact points 17 and 27 associated, respectively, with the bimetallic strip 13 and the bimetallic disc 26 may be mounted on intermediate links which are moved by the bimetallic elements.

Suitably, the temperature-dependent semiconductor element 31 is disposed within the housing 1 but it may also be located externally thereof. Again, the illustrated exemplary embodiments provide a circuit in which electrical communication is established between the pins 9' and 9'' with respect to the housing 1. However, the invention also includes switches containing separate or additional contacts for permitting electricl circuits to be established with the pins 9' and 9''.

All of the cited characteristics and combinations are subject to variations and modifications lying within the competance of persons skilled in the art and fall within the spirit and scope of the invention.

Figure 4:
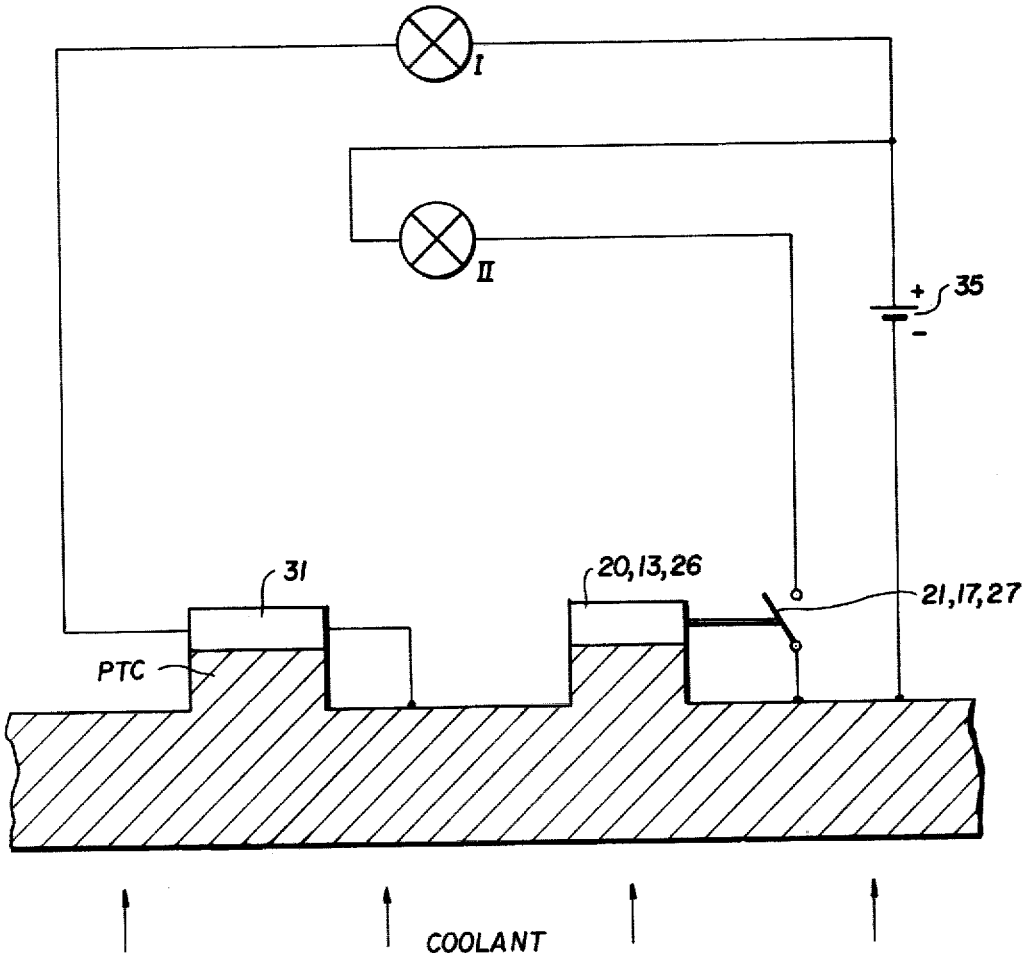
FIG. 4 is a schematic circuit diagram of two independent switches, each responsive to the temperature of a housing which contacts the coolant of an engine in a vehicle, which circuits uses any one of the two-stage switches shown respectively in FIGS. 1-3 in accordance with the present invention.

As shown in FIG. 4, a housing 1, with which a coolant, designated by the arrowheaded lines, for an engine in a vehicle or the like, has in thermal contact therewith a temperature-dependent semiconductor element 31, shown as positive temperature coefficient (PTC) resistor. It is to be appreciated that a negative temperature coefficient (NTC) resistor could be used instead of the positive temperature coefficient resistor. One electrical terminal of the element 31 is grounded to the housing 1, the other terminal is connected, via a first warning light I to a first terminal of a battery 35, its other terminal being cnnected to the housing 1. The circuit components 31, I and 35 form a first electrical switch circuit.

The circuit of FIG. 4 is provided with a second electrical switch circuit which is independent of the above mentioned first electrical switch circuit. The second switch circuit includes a second switch circuit having a movable contact member, designated by the numeral 21, 17 and 27 corresponding to respective members having the same numerals in FIGS. 1–3. The second electrical switch circuit includes a second warning light II and the battery 35. This second electrical switch circuit is electrically independent of the first electrical switch circuit.

It is clear that the temperature sensitive resistor 31 and the members 20, 13 and 26 are in effect coupled thermally not in series but in parallel to the housing 1, as can be seen from FIGS. 1–3 and as shown diagrammatically in FIG. 4.

1. An electrical switch assembly responsive to temperature of a coolant in a cooling system of an internal combustion engine, the assembly comprising:

a housing against at least a portion of which the coolant is to come;

an insulating contact pin plate closing off said housing;

at least a first contact pin and a second contact pin extending through said contact pin plate;

a first switch arranged in said housing, said first switch consisting of a temperature-dependent semiconductor element which is positioned between said housing and said contact pin plate, is in electrical series with said first contact pin in a first electrical circuit and is coupled thermally to said housing;

a second switch arranged in said housing, said second switch consisting of a temperature-dependent mechanical switching element which is connected in series with said second contact pin in a second electrical circuit and is thermally coupled to said housing independently of said first switch, said first switch and said switching element being thermally coupled not in series but in parallel to said housing and wherein triggering temperature of said second switch is different from that of said first switch.

2. An electrical switch assembly according to claim 1, wherein said temperature-dependent semiconductor element (31) is a cold conductor (PTC-resistor).

3. An electrical switch assembly according to claim 1 wherein said temperature-dependent semiconductor element (31) is a hot conductor (NTC-resistor).

4. An electrical switch assembly according to claim 1, wherein said temperature-dependent semiconductor element (31) is a circular annulus.

5. An electrical switch assembly according to claim 4, further comprising an electrical contact ring disposed between said semiconductor element and said contact pin plate and having flexible fingers making electrical contact with said semiconductor element.

6. An electrical switch assembly according to claim 1, wherein said temperature-dependent semiconductor element is disc-shaped.

7. An electrical switch assembly according to claim 6, further comprising an electrical contact ring disposed between said contact pin plate and said semiconductor element, and having flexible fingers making electrical contact with said semiconductor element and said flexible fingers further making electrical contact with one of said electrical contact pins.

8. An electrical switch assembly according to claim 1, wherein said mechanically acting switching element of said second switch includes an actuating lever pivoted in an extension of one of said electrical contact pins, and, cooperating therewith a contact post loaded by a spring and capable of being placed in either of two stable positions due to interaction with said actuating lever.

9. An electrical switch assembly according to claim 8, wherein said contact post alternates between making and breaking electrical communication in the associated circuit.

10. An electrical switch assembly according to claim 8, wherein said housing defines an interior space containing a material whose volume depends on temperature, said space being closed by a flexible diaphragm, the motions of said diaphragm being transmitted to said actuating lever for said mechanical switching element.

11. An electrical switch assembly according to claim 1, wherein said temperature-dependent mechanically acting switching element of said second switch is a bimetallic strip disposed in a hollow space in said housing, the movable end of said bimetallic strip having an electrical contact point which cooperates with a second contact point electrically communicating with one of said electrical contact pins in said contact plate.

12. An electrical switch assembly according to claim 11, wherein said bimetallic strip is fastened to the base of the hollow space in said housing.

13. An electrical switch assembly according to claim 1, wherein said mechanically acting switching element of said second switch is a bimetallic snap-disc disposed in an interior space of said housing, and it is provided with an electrical contact point cooperating with a second electrical contact point connected to one of said electrical contact pins in said plug member; whereby, when the temperature of said bimetallic snap-disc increases, electrical communication is established between said contact pin and said snap-disc.

14. An electrical switch assembly according to claim 13, wherein said bimetallic snap-disc lies on the base of said hollow space in said housing without constraints.

* * * * *